US006466751B2

(12) United States Patent
Kawano

(10) Patent No.: US 6,466,751 B2
(45) Date of Patent: Oct. 15, 2002

(54) IMAGE FORMING APPARATUS HAVING A CONTROLLER FOR CONTROLLING PAPER FEED INTERVALS

(75) Inventor: Hisaaki Kawano, Chigasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/821,766

(22) Filed: Mar. 30, 2001

(65) Prior Publication Data

US 2002/0141772 A1 Oct. 3, 2002

(51) Int. Cl.[7] ..... G03G 15/20
(52) U.S. Cl. ..... 399/68; 399/69
(58) Field of Search ..... 399/44, 67, 68, 399/69, 320, 322, 328, 335; 219/216

(56) References Cited

U.S. PATENT DOCUMENTS 4,673,283 A * 6/1987 Hisajima et al. ..... 399/68 X
5,289,247 A * 2/1994 Takano et al. ..... 399/68
5,552,874 A * 9/1996 Ohtsuka et al. ..... 399/335
5,621,511 A * 4/1997 Nakayama ..... 399/69 X

FOREIGN PATENT DOCUMENTS

JP 07-199694 8/1994

* cited by examiner

*Primary Examiner*—Sophia S. Chen
*Assistant Examiner*—Hoan Tran
(74) *Attorney, Agent, or Firm*—Foley & Lardner

(57) ABSTRACT

An image forming apparatus for forming an image on paper has a controller for changing paper feed intervals of a feeding device based on a mode set by a setting device. The controller may stop the feeding of the paper by the feeding device based on a temperature at an end portion of the fixing device detected by a temperature detector. The controller may control the paper feed intervals in such a manner that the paper feed intervals are small for a paper having a width greater than a threshold, large for a paper having a width; equal to or less than the threshold with no designation of a high using frequency, and small for a paper having a width equal to or less than the threshold with a designation of a high using frequency.

11 Claims, 6 Drawing Sheets

IMAGE FORMING APPARATUS HAVING A CONTROLLER FOR CONTROLLING PAPER FEED INTERVALS

BACKGROUND OF THE INVENTION

1. Field of the Invention

The present invention relates to an image forming apparatus, and more particularly, such an apparatus provided with a fixing device for fixing a toner image formed on a recording material in the form of a paper for image formation processing thereon, and a feeding device for feeding or conveying the paper to the fixing device and ejecting it.

2. Description of the Related Art

In a known image forming apparatus, a first and a second thermistor are arranged for detecting the temperature of a central portion and one end portion, respectively, of a heating roller of the fixing device so that the temperatures of the entire heating roller can be controlled to be kept within an allowable range. Such an image forming apparatus, however, when printing is continuously effected on sheets of paper of a narrow width such as A4R, B5 and A5, a central portion of the heating roller is deprived of heat by the paper in contact therewith, so that the temperature thereof lowers. Then, if the heating roller is heated to recover the temperature lowered, the temperature at the end portions of the heating roller from which heat is not deprived might go up too much. The technology disclosed in Japanese Patent Application Laid-Open No. 7-199694 for instance is known as a proposal for solving this problem. This image forming apparatus feeds or conveys sheets of paper in such a manner that the center line of each sheet passes the center of heating roller, with the paper feed timing being changed according to the width of the paper. For instance, when printing on a paper of a narrow width such as an envelope, the temperature at the end portions of the heating roller is prevented from rising to a high temperature by decreasing the paper feed timing or rate from a conventional rate of 34 pieces per minute to 2.5 pieces per minute.

Since the above-mentioned known image forming apparatus changes the paper feed timing in accordance with the width of the paper to be printed, the printing speed for a narrow paper is decreased uniformly. Therefore, though it is not desirous that the temperature at the end portions of the heating roller exceeds the allowable range too much frequently, there is a demand that the paper frequently used (i.e., the amount of use is large) among narrow papers is to be processed or printed at high speed.

SUMMARY OF THE INVENTION

The present invention is intended to solve the above-mentioned problems and has for its object to provide an image forming apparatus in which the printing speed is able to be changed according to the demand of the user. In addition, another object of the present invention is to provide an image forming apparatus which is capable of processing continuous printing as efficiently as possible in a range where the temperature of a fixing device does not exceed an allowable temperature range.

In order to solve the problems as described above, the present invention resides in an image forming apparatus for forming an image on a paper, which comprises: a fixing device for heating an image transferred to a paper to fix it thereon; a feeding device for feeding the paper to the fixing device; a setting device for setting a mode of paper feed intervals of the feeding device; and a controller for changing the paper feed intervals of the feeding device based on the mode set by the setting device.

According to such a construction, the paper feed intervals can be changed based on a mode which is set by the user, etc., thus making it possible to fulfill the user request for processing speed during continuous printing. In a preferred form of the present invention, the fixing device comprises a pressure roller 6 and a heating roller 7, and the feeding device comprises a paper feed path 3, and rollers such as paper feed rollers 2, a register rollers 4, etc., arranged along the paper feed path. In addition, the setting device for setting a mode comprises a console panel 14, and the controller comprises a CPU 20.

Further, in the image forming apparatus of the present invention, the modes to be set by the setting device include at least either one of a first mode in which the paper feed intervals are changed based on the size of a paper and a second mode in which the paper feed intervals are changed based on the using frequency of a paper size.

In case of a small paper size, it is difficult to absorb heat at the end portions of the fixing device as compared with the central portion thereof, and hence when the fixing device is heated based on the temperature of the central portion thereof, the temperature at the end portions of the fixing device is easy to rise, thus exceeding an allowable range easily as compared with the temperature at the central portion thereof. In contrast, in case of a large paper size, heat at the end portions of the fixing device can be easily absorbed like at the central portion thereof, and hence the temperature at the end portions of the fixing device does not exceed the allowable range easily. Therefore, with the provision of such a mode (the first mode) in which the paper feed intervals can be changed in consideration of the paper size, there can be achieved such a construction as to prevent the temperature at the end portions of the fixing device from exceeding the allowable range without reducing the efficiency in continuous printing. Moreover, in case of a high using frequency, it is possible to efficiently perform processing as a whole if the paper feed intervals can be reduced, whereas in case of a low using frequency, even if the paper feed intervals are increased, there will be no much influence on reduction in the overall efficiency in continuous printing processing (continuous image formating processing). Accordingly, in case of the low using frequency, increasing the paper feed intervals serves to prevent the temperature at the end portions of the fixing device from rising beyond the allowable range. Thus, according to the present invention, efficiency in continuous printing can be improved.

Moreover, according to the present invention, in the first mode, the paper feed intervals are set to be smaller when the paper size is large than when the paper size is small.

In case of a small paper size, heat is more difficult to be aborbed at the end portions of the fixing device than at the central portion thereof, and hence when the fixing device is heated based on the temperature of the central portion thereof, the temperature of the fixing device rises more easily to exceed an allowable range at the end portions thereof than at the central portion thereof. In contrast, in case of a large paper size, heat at the end portions of the fixing device can be easily absorbed like at the central portion thereof, and hence the temperature at the end portions of the fixing device does not exceed the allowable range easily. Therefore, it is possible to set the paper feed intervals smaller when the paper size is large than when the paper size is small, thereby increasing the speed and efficiency in continuous printing processing.

Furthermore, according to the present invention, in the second mode, the paper feed intervals are set smaller for the paper of a high using frequency than for the paper of a low using frequency.

When the using frequency is high, reducing the paper feed intervals serves to efficiently perform processing as a whole. On the other hand, when the using frequency is low, increasing the paper feed intervals does not influence reduction in the overall efficiency in continuous printing processing so much. Thus, in case of a high using frequency, by reducing the paper feed intervals, continuous print processing is sped up for improved efficiency as a whole.

In addition, the image forming apparatus of the present invention further comprises a temperature detector for detecting the temperature at the end portions of the fixing device. The controller stops the feeding of paper by the feeding device based on the temperature at the end portions of the fixing device detected by the temperature detector.

Further, in the present invention, the mode set by the setting device includes a mode in which the paper feed intervals are set to be smaller when the paper size of the paper is large than when the paper size of the paper is small, and in which when the temperature of the fixing device exceeds a predetermined value, the controller stops, based on the temperature at the end portion of the fixing device detected by the temperature detector, the feeding of the paper by the feeding device until the temperature of the fixing device falls to or below the predetermined value.

Furthermore, in the present invention, the mode set by the setting device includes a mode in which the paper feed intervals are set to be smaller when a paper of a size has a designation of a high using frequency than when a paper of the same size has no designation of a using frequency, and in which when the temperature of the fixing device exceeds a predetermined value, the controller stops, based on the temperature at the end portion of the fixing device detected by the temperature detector, the feeding of the paper by the feeding device until the temperature of the fixing device falls to or below the predetermined value.

According to the constructions as described above, the temperature at the end portion of the fixing device can be prevented from exceeding the allowable range while improving the efficiency in continuous printing processing.

Still further, an image forming apparatus according to the present invention comprises: a heating roller for fixing a toner image formed on a paper to the paper so as to perform processing of image formation on the paper as a recording material and eject the paper; a fixing temperature control device for controlling the temperature of the heating roller so as to be kept within an allowable range; and a controller for controlling paper feed intervals in such a manner that the paper feed intervals are small for a paper having a width greater than a threshold, large for a paper having a width equal to or less than the threshold with no designation of a high using frequency, and small for a paper having a width equal to or less than the threshold with a designation of a high using frequency.

With such a construction, in case of using a paper of a wide width in the fixing process, it is possible to prevent the temperature only at the end portions of the heating roller from rising excessively beyond the allowable range, enabling processing of image formation to be carried out at high speed for improved efficiency. On the other hand, in case of a narrow paper having a low using frequency, as the paper feeding speed increases, the temperature at the end portions alone of the heating roller is liable to rise excessively beyond the allowable range, and hence the narrow paper is fed at low speed even with a decreased efficiency because of the using frequency being low, thus preventing damage to the heating roller, etc. In addition, in case of a narrow paper having a high using frequency, when the paper feeding speed is increased, there occurs a danger that only the end portions of the heating roller become a high temperature exceeding the allowable range, but emphasis is placed on the high using frequency to perform high-speed processing of image formation while permitting the temperature control on the heating roller to be carried out by the fixing temperature control device. Therefore, the efficiency in the image formation processing can be maintained high while reducing damage to the heating roller, etc.

Moreover, in the present invention, the heating roller includes a built-in heater, and the fixing temperature control device comprises: a first temperature detector disposed at a central portion of the heating roller; a second temperature detector disposed at an end portion of the heating roller; and a fixing control circuit for controlling the heater of the heating roller based on the temperatures detected by the first and second temperature detectors in such a manner that the temperatures of the heating roller are kept within an allowable range. Thus, the temperature detection of the heating roller can be carried out by a simple construction using the two thermistors. For instance, the heater can be heated by high-frequency current with good response and high efficiency.

Besides, when the temperature detected by the second temperature detector of the fixing temperature control device exceeds the allowable range during high-speed feeding of a narrow paper having a high using frequency, the controller temporarily stops image forming processing until the detected temperature returns to fall within the allowable range under the control of the fixing temperature control device. Thus, it is possible to cope, in a simple manner, with such a situation in which the temperature at the end portion of the heating roller exceeds the allowable range.

DESCRIPTION OF THE PREFERRED EMBODIMENT

Figure 1:
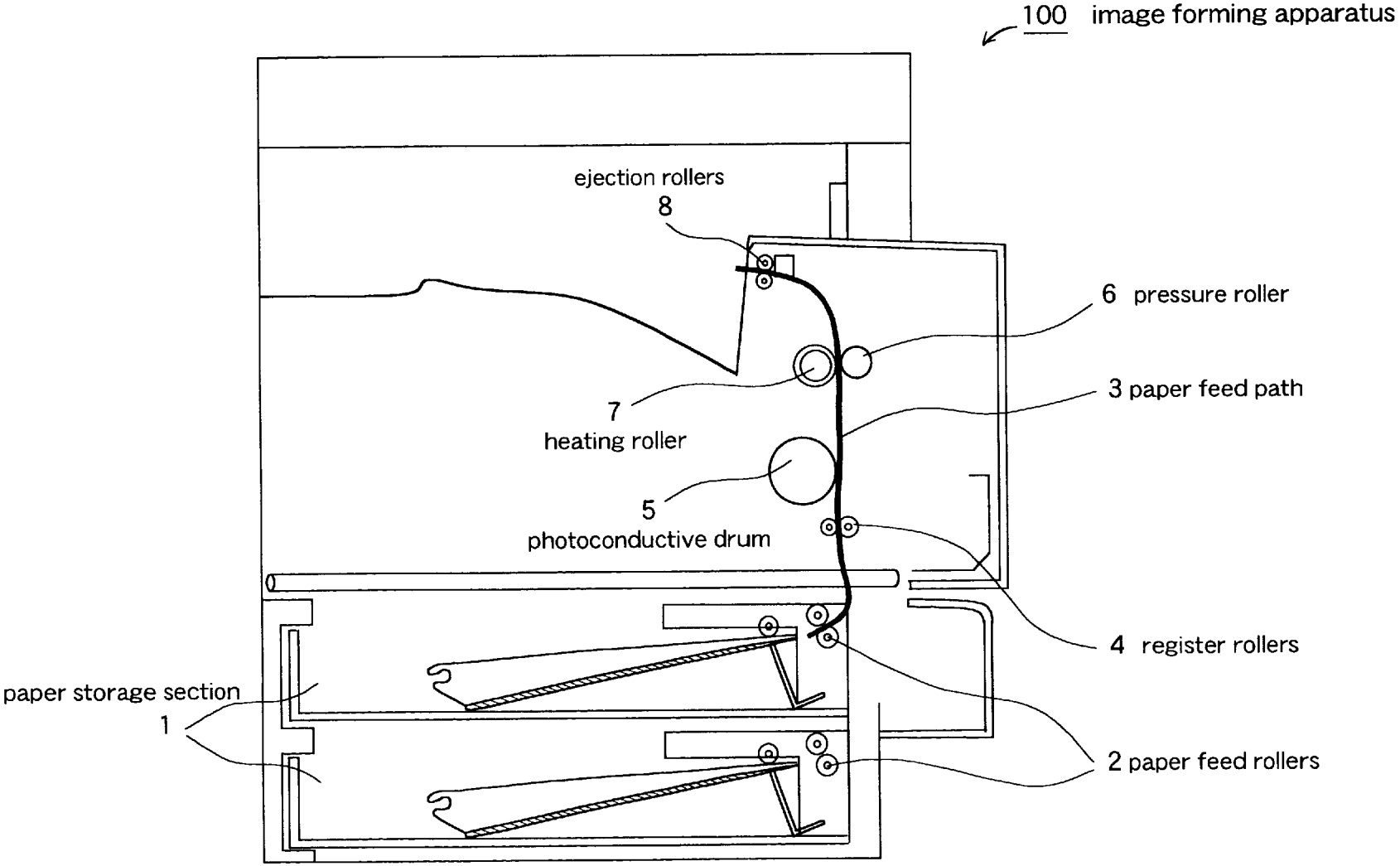
FIG. 1 is a longitudinal sectional view of the essential parts of an image forming apparatus according to an embodiment of the present invention as seen from the front side thereof.
Figure 2:
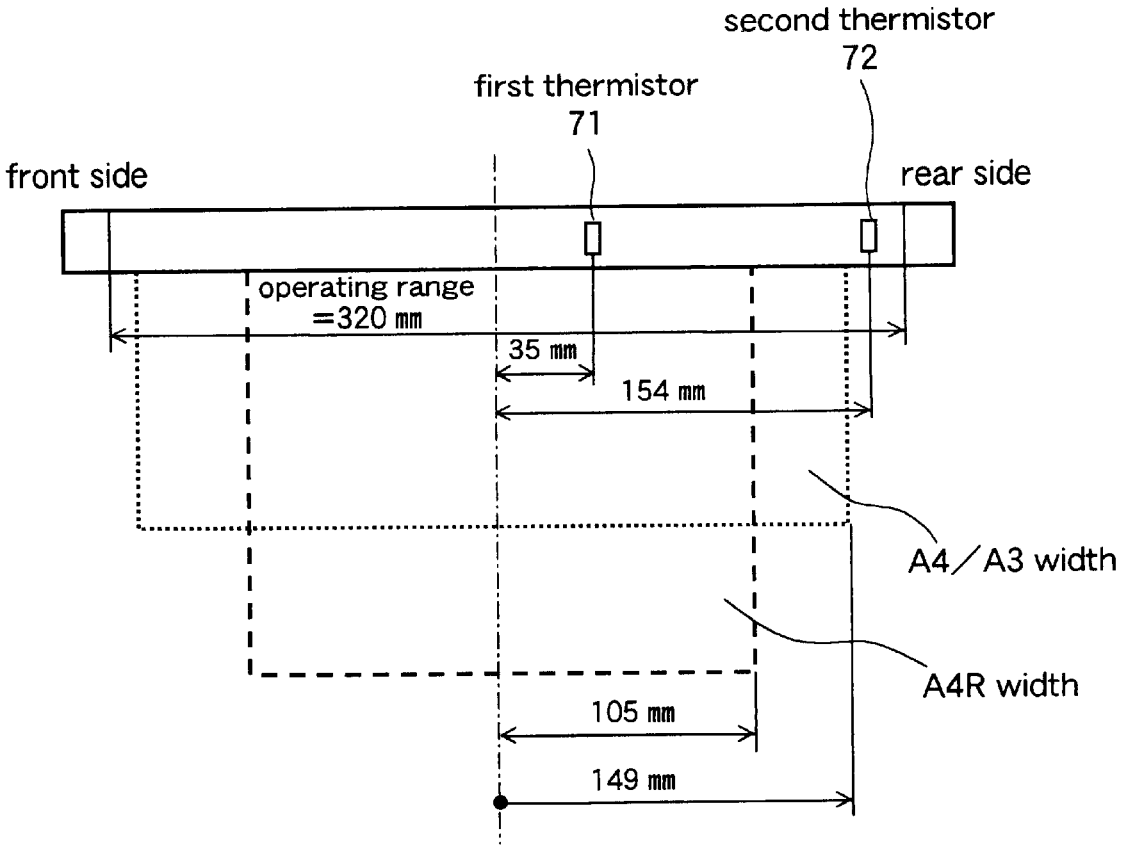
FIG. 2 is a view illustrating the positional relation among a first and a second thermistor and a sheet of printing paper arranged in association with a heating roller illustrated in FIG. 1.
Figure 3:
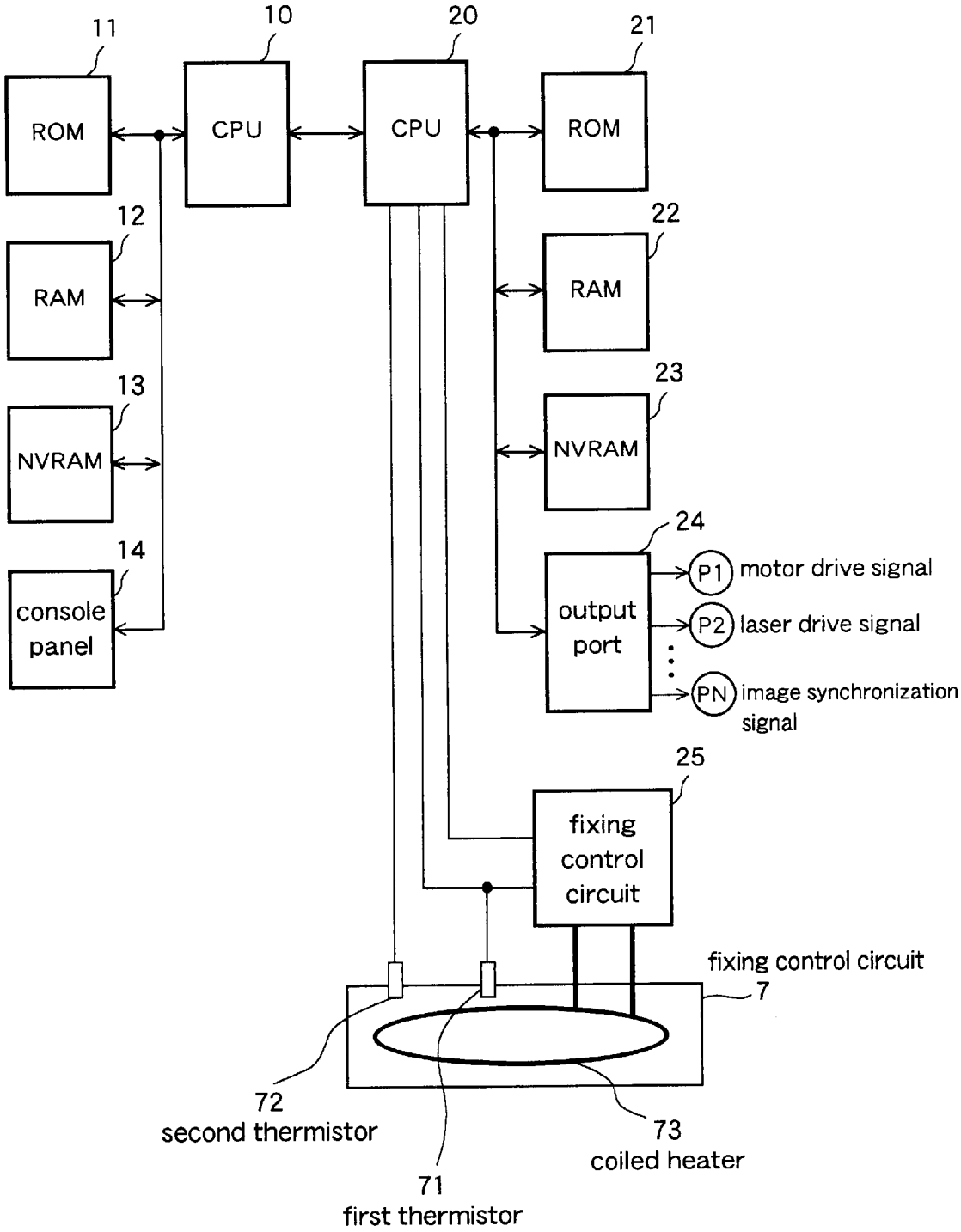
FIG. 3 is a block diagram illustrating a control circuit of the image forming apparatus of FIG. 1.

Now, a preferred embodiment of the present invention will be described in detail while referring to; the accompanying drawings. FIG. 1 illustrates, in a longitudinal section, the essential portions of an image forming apparatus, as seen from the front side thereof, according to an embodiment of the present invention is illustrated. FIG. 2 illustrates the positional relation among a first and a second thermistor and a sheet of printing paper arranged in association with a heating roller illustrated in FIG. 1. FIG. 3 illustrates, in a block diagram, a control circuit of the image forming apparatus of FIG. 1. As illustrated in FIG. 1, in the image forming apparatus 100, a recording material in the form of a sheet of paper is drawn out from a paper storage section 1 by means of paired paper feed rollers 2, and fed to a pair of register rollers 4. Then, the paper is driven to pass the register rollers 4 at proper timing and further carried along a paper feed path 3 to a photoconductive drum 5 (hereinafter, simply referred to as a drum) so as to face it, as illustrated in FIG. 1 (here, note that various control operations to be described in this example are performed by a CPU 10 and a CPU 20 as illustrated in FIG. 3).

A toner image (including printed characters) is formed on that surface of the paper which faces the drum 5, by means of an electrophotographic process (in this example, using laser light). The paper having the toner image formed on its surface is further fed along the paper feed path 3 to pass between a pair of pressure roller 6 and heating roller 7. During the passage, the image on the paper surface is fixed to the paper by means of the pressure of the pressure roller 6 and the heat of the heating roller 7. After the fixing, the paper is further conveyed to and ejected from a pair of ejection rollers 8. On the heating roller 7 used for the above-mentioned process, there are provided a heater for heating the paper (see FIG. 3), a first thermistor 71 for detecting the temperature at the central portion of the heating roller 7, and a second thermistor 72 for detecting the temperature at one end portion of the heating roller 7 (see FIG. 2 and FIG. 3).

FIG. 2 illustrates one example of the heating roller 7 which was used in an experiment and has its central portion of 320 mm used as an operating range with the central line of the sheet of recording material being conveyed to pass along the center of the heating roller 7. The first thermistor 71 is arranged at a location reawardly of the center of the heating roller 7 at a distance of 35 mm apart therefrom, and the second thermistor 72 is also arranged at a location reawardly of the center of the heating roller 7 at a distance of 154 mm apart therefrom. In this case, the thermistor 71 serves to detect the temperature at the central portion of the heating roller 7, and the thermistor 72 serves to detect the temperature at the one end portion of the heating roller 7. In cases where this heating roller 7 is used, in a fixing process, a sheet of paper having a width of A4/A3 size covers the heating roller 7 in its range of 154 mm from the center thereof to the opposite ends thereof, and the one having a width of A4R size covers the heating roller 7 in its range of 105 mm from the center thereof to the opposite ends thereof. Here, note that the width of paper is set such that using the width of A4R paper (105×2 =210 mm) as a threshold, paper having a width less than this threshold is determined as a narrow paper, and the one having a width greater than this threshold is determined as a wide paper (though such a determination can be changed by a new setting).

Now, the control circuit of the image forming apparatus 100 will be described while referring to FIG. 3. The CPU 10 for controlling the system takes in data from its outside, perform s processing thereon and displays the results of processing by using a ROM 11, a RAM 12, an NVRAM (nonvolatile RAM) 13 and a console panel 14, and it also gives various commands to the CPU 20 for controlling mechanical mechanisms (in this example, through serial communications). The settings for the width of paper and the using frequency used for the determination of a later-mentioned cycle time can be input by using the above-mentioned console panel 14. The console panel 14 constitutes a mode setter or setting device of the present invention. In that case, it is desirable to store the determination result of the cycle time in the NVRAM 13. The CPU 20 outputs, based on the given commands, drive signals (for instance, a motor drive signal P1 for a motor of each part, a laser drive signal P2, . . . , an image synchronization signal PN), etc., from an output port 24 to various parts by using a ROM 21, a RAM 22 and an NVRAM (nonvolatile RAM) 23.

Further, the CPU 20 transmits a status signal related to the control on the mechanical mechanisms, etc., to the CPU 10 to notify it of control states thereof and necessary timing therefor. In this case, the data for which temporal storage is necessary is stored in the RAM 22, and the adjusted values and the set values having a possibility of being different in respective image forming apparatuses are stored in the NVRAM 23 so that those values are not lost even if the power supply is turned off. Moreover, the CPU 20 controls the paper feed, etc., by means of the motor drive signal P1 based on control programs read out from the ROM 21, takes in the temperatures of the heating roller 7 detected by the first and second thermistors 71 and 72 through an A/D converter (not shown), and drives a fixing control circuit 25 according to control programs stored in the ROM 21, so that a high-frequency current is supplied to a coiled heater 73 mounted on the heating roller 7, thereby heating the heating roller 7 to an appropriate temperature through induction heat for temperature control.

Figure 4:
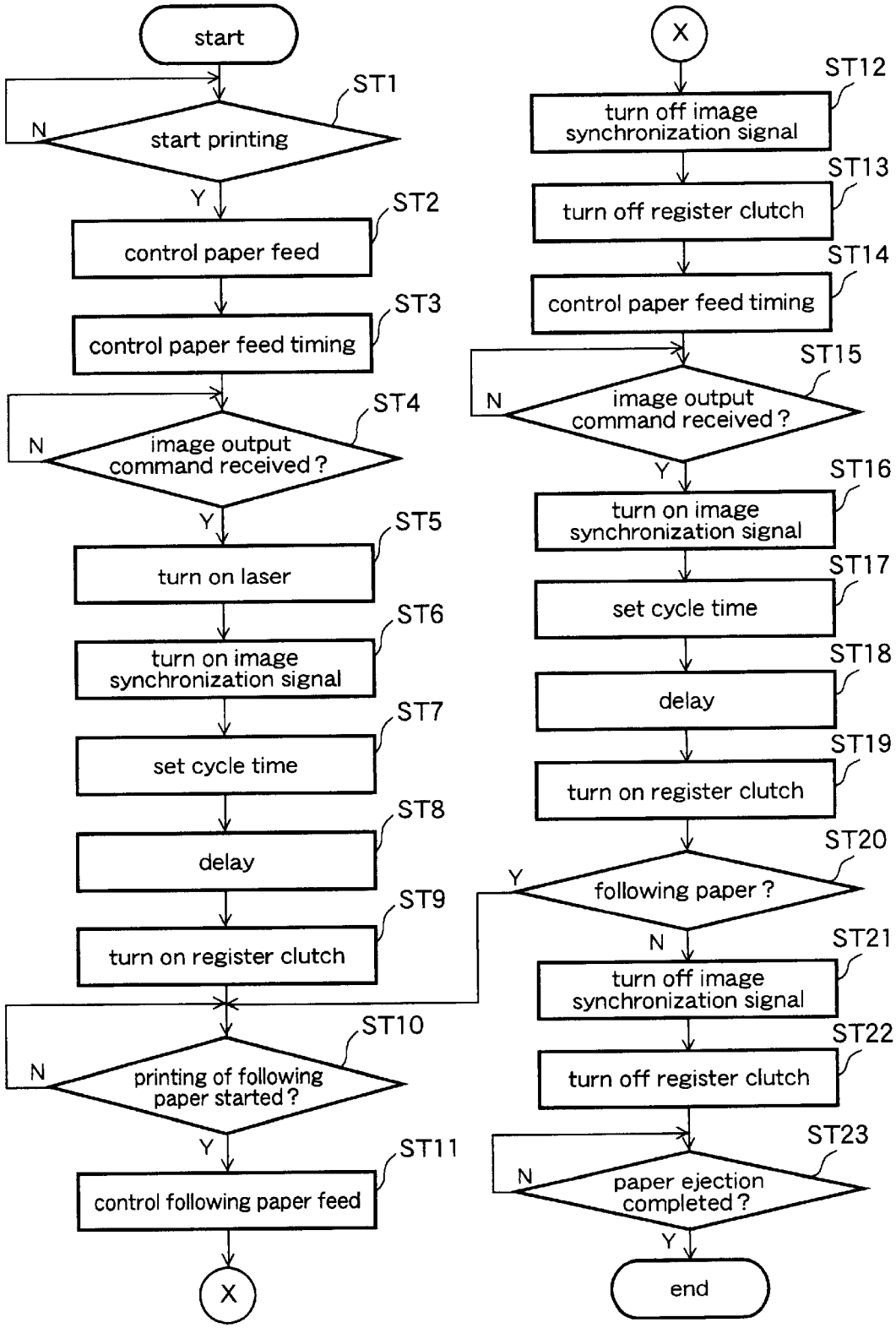
FIG. 4 is a flow chart for explaining the printing operation of the image forming apparatus illustrated in FIG. 1 through FIG. 3.
Figure 5:
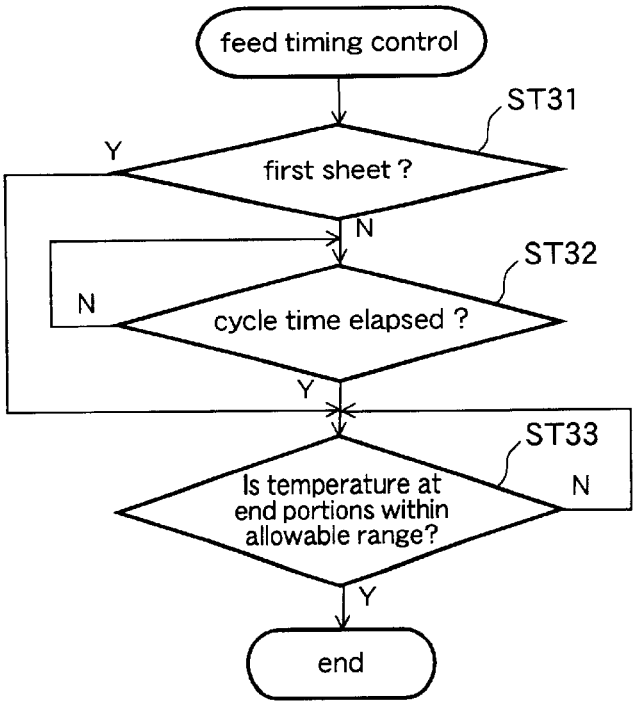
FIG. 5 is a flow chart for explaining paper feed timing control shown in FIG. 4.
Figure 6:
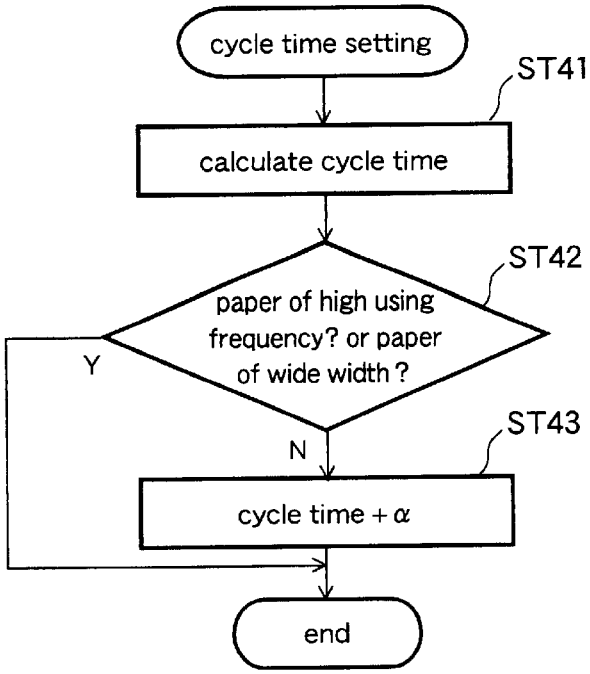
FIG. 6 is a flow chart for explaining a cycle time determining method used for setting a cycle time in FIG. 4.

Next, the printing operation of this image forming apparatus 100 will be described while referring to flow charts of FIG. 4 through FIG. 6. When the power supply is turned on, the CPU 10 starts warming-up operations, becomes a waiting state when all the warming-up operations have been completed including instructing the CPU 20 to warm up, and determines whether there has been generated a print starting command from the console panel 14 (step ST1). Upon receipt of a print starting command, the CPU 20 controls paper feed (step ST2). Nearly at the instant when a tip end of the paper having been drawn out from the paper storage section (cassette) 1 according to the paper feed control reaches the register rollers 4, paper feed timing control (to be described later) is carried out (step ST3). When the paper feed timing control is finished, the CPU 20 becomes a state waiting for an image output command from the CPU 10 (step ST4).

When the CPU 20 receives an image output command in step ST4, a laser is turned on (step ST5) and an image synchronization signal is made into an on state (step ST6). As a result, image data is transmitted to and processed by an image processing circuit (not shown), based on the result of which laser light is controlled to be turned on and off so that a latent image is formed on the drum 5 by means of the on/off controlled laser light. Then, a cycle time (this value being described later) for determining an image output timing with respect to the paper to be printed next (image formed) is set and a cycle timer is started (step ST7). A. predetermined time is delayed from the timing when the image synchronization signal is made into an on state (step ST8), and the following processing is continued until a first sheet of paper is ejected, and the register clutch is turned on (step ST9), and it is then determined whether there has been generated a print starting command with respect to the following paper (i.e., a second sheet of paper with respect to the first one) (step ST10).

Upon receipt of a print starting command in step ST10, the CPU 20 controls the feeding of the following paper (i.e., the second sheet of paper with respect to the first one) (step ST11), outputs an image synchronization signal for one page of a preceding sheet (i.e., the first sheet with respect to the second sheet), then makes the image synchronization signal into an off state (step ST12) and turns off the register clutch (step ST13). Nearly at the instant when the tip end of the paper having been drawn out from the paper storage section (cassette) 1 according to the paper feed control reaches the register rollers 4, paper feed timing control (to be described later) is carried out (step ST14). When the paper feed timing control is finished, the apparatus becomes a state waiting for an image output command to this paper (described as the current paper) on which an image is formed (step ST15). Upon receipt of the image output command in step ST15, the CPU 20 makes the image synchronization signal into an on state (step ST16).

After the step ST16, a cycle time for determining the image output timing with respect to a paper following the current paper is set, and the cycle timer is started (step ST17). A predetermined time is delayed from the timing at which the image synchronization signal with respect to the current paper is made into an on state (step ST18), and the register clutch is turned on (step ST19). A determination is made whether there is a need for printing on the paper following the current paper, and when there is such a need, the following processing is carried out until the current paper is ejected, and the processes from step ST10 are performed again (step ST20). When there is not such a need for printing on the paper following the current paper in step ST20, the image synchronization signal is made into an off state (step ST21). The register clutch is also turned off (step ST22). Subsequently, the control process proceeds to a paper ejection step, and when it is determined that the ejection of the paper is completed, the control process is ended.

Next, the paper feed timing control of the steps ST3 and ST14 will be described while referring to FIG. 5. The paper feed intervals (paper feed timing) are controlled in these steps. That is, it is determined whether the paper to be printed is a first sheet (step ST31). When it is determined that the paper to be printed is not a first sheet (i.e., a second or following sheet), the control process waits for the timer started in step ST7 or ST17 being timed out (step ST32). When the timer is timed out, it is then determined whether the temperature detected by the second thermistor 72 is in an allowable range, and if the temperature detected becomes within the allowable range, the control process. goes to the following step. When it is determined in step ST31 that the paper to be printed is a first sheet, the control process goes to step ST33. When it is determined that the temperature detected by the second thermistor 72 becomes within the allowable range, the control process proceeds to the following step.

In addition, the calculation of the cycle time set in step ST7 or ST17 will be described while referring to FIG. 6. Here, it is assumed that this calculation is carried out before the operation shown in FIG. 4. The necessary intervals between the sheets of paper to be fed are calculated based on the number of sheets which can be fed per unit time corresponding to the size of the paper (for instance, A5, A4, A4R, B5, B4 and A3, etc.) (step ST41). Subsequently, a determination is made whether it is specified that the width of this paper is wide or that the using frequency thereof is high (step ST42). When it is specified, as a result of the determination, that the width of the paper is not wide or the using frequency thereof is not high, the paper feed intervals are increased by adding $\alpha$ to the cycle time calculated in step ST41 (ST43), and the thus calculated value is made as the cycle time to be actually used. Moreover, when in the determination in step ST42, it is specified that the width of the paper is wide or the using frequency thereof is high, the cycle time calculated in step ST41 is made as the cycle time to be actually used, and the paper feed intervals are reduced than in case of the former.

To summarize the major points of control related to the purposes of the image forming apparatus, the settings of the width and the using frequency of paper used for the determination of the cycle time can be input as modes of paper feed intervals by using the console panel 14 or set-up switches incorporated therein. In addition, the results of determination of the cycle time are stored in the NVRAMs 13 and 23, etc. This cycle time is used upon printing in steps ST7 and ST17. Thus, there is little possibility that the heating roller 7 becomes at a high temperature only at the end portions thereof even with the use of a wide paper, and hence processing (printing, paper feeding, etc.) can be performed at high speed (at a setting of the calculated cycle time). Since there is a high possibility that the heating roller 7 becomes at a high temperature only at the end portions thereof for a narrow paper, processing is performed at low speed (at a setting of the calculated cycle time+$\alpha$), so that a time margin is given to permit the temperatures at the central portion and the end portions of the heating roller 7 to approach each other through temperature control thereby to prevent them from exceeding the allowable range. As a result, it is possible to avoid adverse thermal influences on the heating roller 7, etc. The value of $\alpha$ differs according to the structure of the apparatus, and hence this value is determined through experiments in advance (of course, this value can be re-set when a change is necessary in some circumstances).

Figure 7:
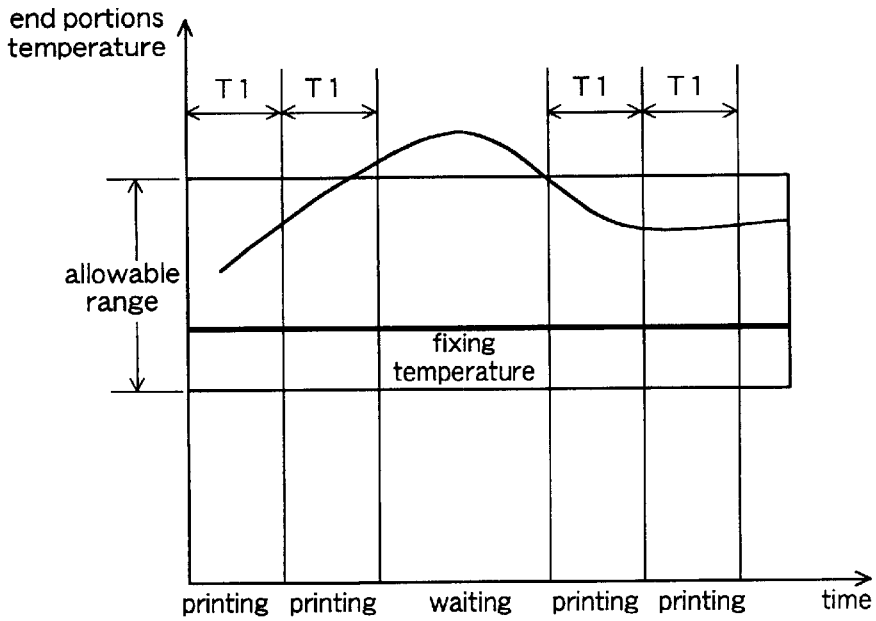
FIG. 7 is a graphic representation for explaining the relation between the image forming operation for frequently used narrow paper and a temperature change at end portions of the heating roller.
Figure 8:
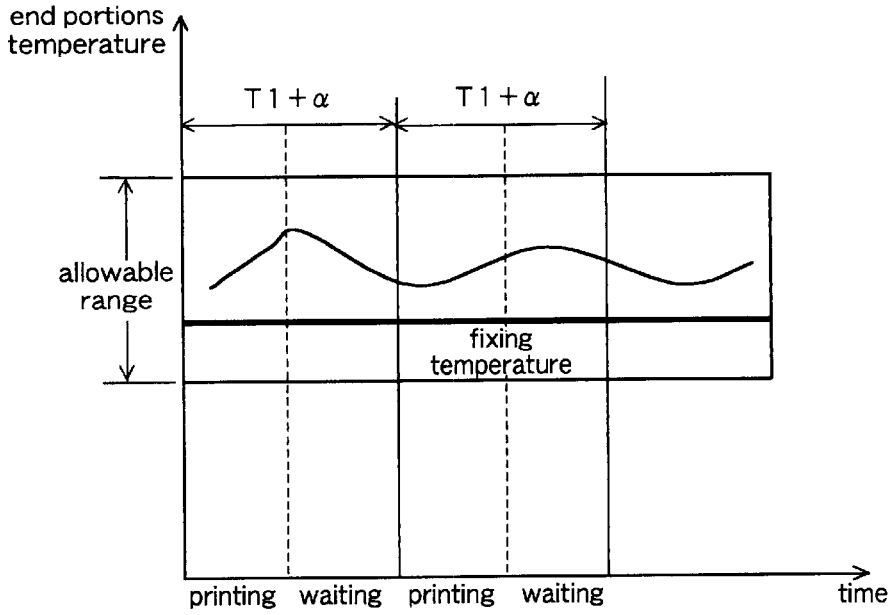
FIG. 8 is a graphic representation for explaining the relation between the image forming operation for less frequently used narrow paper and a temperature change at end portions of the heating roller.

In the above-mentioned control, a narrow paper is processed at high speed without uniformly taking large paper feed intervals when it is specified that the using frequency is high, and processing is temporarily stopped only when the temperature at the end portions of the heating roller 7 exceeds the allowable range, so that high-speed processing is resumed at the instant the temperature at the end portions of the heating roller 7 returns to the allowable range. Therefore, printing can be efficiently performed on a paper of a high using frequency, whereas low-speed processing is effected in case of a paper having a low using frequency to minimize the case where the temperature at the end portions of the heating roller 7 exceeds an allowable limit. Since this image forming apparatus has been programmed as referred to above, it is advantageous in that a required efficiency can be ensured and durability can also be maintained. FIG. 7 and FIG. 8 are timing charts illustrating the printing operation as described of the major points. In FIG. 7, processing is performed at high speed (T1), and it is temporarily stopped only when the temperature at the end portions of the heating roller 7 exceeds the allowable range. In FIG. 8, processing is carried out at low speed (T1+$\alpha$), and hence the temperature at the end portions of the heating roller 7 will not exceed the allowable range.

Since the image forming apparatus according to the embodiment of the present invention is constructed as described above, even with the use of wide paper in a fixing process, the temperature at the end portions alone of the heating roller does not rise to a high temperature beyond the allowable range, and hence the processing of image formation can be performed at high speed, thus improving the efficient in operation. In case of a narrow paper having a low using frequency, as the paper feeding speed increases, the temperature at the end portions alone of the heating roller is liable to rise excessively beyond the allowable range, and hence the narrow paper is fed at low speed even with a decreased efficiency because of the using frequency being low, thus preventing damage to the heating roller, etc. On the other hand, however, in case of a narrow paper having a high using frequency, when the paper feeding speed is increased, there occurs a danger that only the end portions of the heating roller become a high temperature exceeding the allowable range, but emphasis is placed on the high using frequency to perform high-speed processing of image formation while permitting the temperature control on the heating roller to be carried out by a fixing temperature control device. Thus, settings can be varied for the ease of use, and at the same time, the efficiency in the image formation processing can be maintained high while reducing damage to the heating roller, etc.

What is claimed is:

1. An image forming apparatus for forming an image on paper, said apparatus comprising:

a fixing device for heating an image transferred to a paper to fix it thereon;

a feeding device for feeding the paper to said fixing device;

a setting device for setting a mode of paper feed intervals of said feeding device;

a controller for changing the paper feed intervals of said feeding device based on the mode set by said setting device; and a temperature detector for detecting the temperature at an end portion of said fixing device, wherein said controller stops the feeding of the paper by said feeding device based on the temperature at the end portion of said fixing device detected by said temperature detector.

2. The image forming apparatus as set forth in claim 1, wherein the mode set by said setting device includes at least one of a first mode of changing the paper feed intervals based on the size of the paper, and a second mode of changing the paper feed intervals based on a using frequency of the size of the paper.

3. The image forming apparatus as set forth in claim 2, wherein in the first mode, the paper feed intervals are set to be smaller when the paper size is large than when the paper size is small.

4. The image forming apparatus as set forth in claim 2, wherein in the second mode, the paper feed intervals are set to be smaller when the paper size has a high using frequency than when the paper size has a low using frequency.

5. The image forming apparatus as set forth in claim 1, wherein the mode set by said setting device includes a mode in which the paper feed intervals are set to be smaller when the paper size of the paper is large than when the paper size of the paper is small, and in which when the temperature of said fixing device exceeds a predetermined value, said controller stops, based on the temperature at the end portion of said fixing device detected by said temperature detector, the feeding of the paper by said feeding device until the temperature of said fixing device falls to or below said predetermined value.

6. The image forming apparatus as set forth in claim 1, wherein the mode set by said setting device includes a mode in which the paper feed intervals are set to be smaller when a paper of a size has a designation of a high using frequency than when a paper of the same size has no designation of a using frequency, and in which when the temperature of said fixing device exceeds a predetermined value, said controller stops, based on the temperature at the end portion of said fixing device detected by said temperature detector, the feeding of the paper by said feeding device until the temperature of said fixing device falls to or below said predetermined value.

7. The image forming apparatus as set forth in claim 1, wherein said temperature detector is located outside of a passage region of a narrow paper.

8. The image forming apparatus as set forth in claim 1, further comprising a second temperature detector configured to detect a temperature at an approximately central portion of said fixing device.

9. An image forming apparatus comprising:

a heating roller for fixing a toner image formed on a paper to the paper so as to perform processing of image formation on the paper as a recording material and eject the paper;

a fixing temperature control device for controlling the temperature of said heating roller so as to be kept within an allowable range; and a controller for controlling paper feed intervals in such a manner that the paper feed intervals are small for a paper having a width greater than a threshold, large for a paper having a width equal to or less than said threshold with no designation of a high using frequency, and small for a paper having a width equal to or less than said threshold with a designation of a high using frequency.

10. The image forming apparatus as set forth in claim 9, wherein said heating roller includes a built-in heater, and said fixing temperature control device comprises:

first temperature detector disposed at a central portion of said heating roller;

a second temperature detector disposed at an end portion of said heating roller; and a fixing control circuit for controlling said heater of said heating roller based on the temperatures detected by said first and second temperature detectors in such a manner that the temperatures of said heating roller are kept within an allowable range.

11. The image forming apparatus as set forth in claim 10, wherein when the temperature detected by said second temperature detector of said fixing temperature control device exceeds the allowable range during high-speed feeding of a narrow paper having a high using frequency, said controller temporarily stops image forming processing until the detected temperature returns to fall within said allowable range under the control of said fixing temperature control device.

* * * * *